United States Patent [19]

Williams

[11] Patent Number: 4,687,445

[45] Date of Patent: Aug. 18, 1987

[54] SUBSURFACE ANTENNA SYSTEM

[75] Inventor: John C. Williams, Moorestown, N.J.

[73] Assignee: RCA Corporation, Princeton, N.J.

[21] Appl. No.: 236,244

[22] Filed: Feb. 20, 1981

[51] Int. Cl.[4] ..... H01Q 0/4

[52] U.S. Cl. ..... 343/719; 343/814

[58] Field of Search ..... 343/719, 853, 893, 814, 343/815, 816

[56] References Cited

U.S. PATENT DOCUMENTS 3,346,864 10/1967 Harmon ..... 343/719

3,594,798 7/1971 Leydorf et al. ..... 343/719

*Primary Examiner*—Eli Leiberman

*Attorney, Agent, or Firm*—Clement A. Berard, Jr.; Robert L. Troike

[57] ABSTRACT

A subsurface antenna system including at least one pair of radiating elements and feed system is buried within a subsurface medium. The radiating elements comprising the system are spaced apart at least one quarter free space wavelength at an operating frequency. The radiating elements are spaced from each other and the feed system provides appropriate relative phase to signals at the elements to produce from the antenna system a directional antenna pattern in free space.

27 Claims, 31 Drawing Figures

| | | | | |
|---|---|---|---|---|
| R | −180° | 0° | −90° | 90° |
| T | 0° | 0° | −90° | −90° |

SUBSURFACE ANTENNA SYSTEM

This is a continuation-in-part of application Ser. No. 077,914 filed Sept. 24, 1979, now abandoned.

The present invention generally relates to subsurface antennas and, in particular, relates to subsurface antenna systems which suppress undesired radiation and have radiation patterns exhibiting improved directivity.

The use of subsurface antennas, i.e. subterranean or submarine, is advantageous where features such as low maintenance, physical survivability in a hostile environment and suppression of surface clutter noise are required. The term subsurface antenna as used herein refers to antenna elements buried within a semi-infinite dissipative medium, also known as a conducting half-space, of the type discussed in the book entitled DIPOLE RADIATION IN THE PRESENCE OF A CONDUCTING HALF-SPACE by Alfredo Banos Jr., published by Pergamon Press of Long Island City, New York, in 1966. Lack of directivity is a major difficulty of using unarrayed or single subsurface antennas. During transmission, the lack of directivity coupled with other undesired radiation reduces communication security, diffuses the available electromagnetic energy; and, because the ionosphere distorts the polarization of the transmitted energy, makes the antenna appear quasi-omnidirectional without regard to the polarization of the receiving antenna. In the receive mode the lack of directivity causes the antenna to be omnidirectionally sensitive to atmospheric noise and other skywave signal interference.

A number of attempts have been made to improve subsurface antennas; each attempt is quite specialized and stylized for a given end result. One such attempt is described in U.S. Pat. No. 3,346,864 issued to Harmon. The subsurface antenna discussed therein is a single dipole or an array of dipoles surrounded by low conductivity dense rock and located in a hill or mountain having a desired slope. The electrically conductive surface of the antenna is placed closely adjacent the low conductivity rock and preferably in contact therewith so as to excite the rock directly. Another subsurface antenna, described in U.S. Pat. No. 3,803,616 issued to Kopf et al., employs a mound of earth as a lens to increase the efficiency of the radiation from a single dipole. Another subsurface antenna is described in U.S. Pat. No. 3,594,798 issued to Leydorf et al. This antenna system comprises a plurality of buried antenna panels where each panel includes a plurality of pairs of colinear conductors covered with insulation near the feed point but uninsulated and grounded at the ends. The colinear conductors of each panel are closely spaced so that each panel provides a single dipole-type FIG. 8 pattern, but these conductors are sufficiently separated to reduced mutual coupling between them. This spacing is relatd to the frequency and electrical parameter of the ground in which the antenna is located. The four panel antenna system in this patent provides an omnidirectional pattern.

Understandably, in light of prior art subsurface antennas, the need exits for a subsurface antenna system which results in a radiation pattern exhibiting an improved directivity regardless of the subsurface medium.

SUMMARY OF THE INVENTION

In accordance with one embodiment of the present invention there is provided a subsurface antenna system having an improved directional pattern in adjacent free space including first and second radiation elements identically oriented with a semi-infinite dissipative medium and adapted to radiate signals at a given frequency. The radiating elements are coupled to a feed system that provides a selective relative phase between the radiation centers of the elements. The radiating elements are insulated from the medium and are spaced such that their radiation centers are at least one quarter free space wavelength apart at said frequency. The spacing and relative phase being chosen to enhance the directivity pattern of the antenna system in free space.

In the drawing, which is not drawn to scale:

Figure 1:
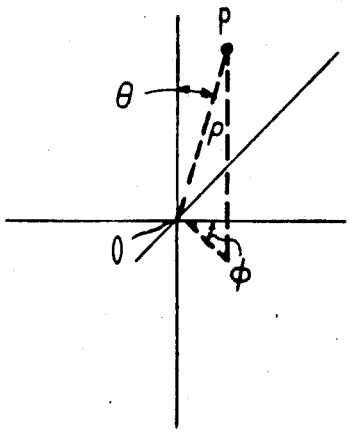
FIG. 1 is a representation defining the polar coordinate system.

A brief review of the polar coordinate system is presented hereinafter as a prelude to the following discussion of various antenna radiation patterns. As shown in FIG. 1, the exact location of a given point "P" in space can be represented by a first angle, $\theta$, a second angle $\phi$ and a distance $\rho$ measured from the coordinate origin "O". In the description of radiation systems in general, the angle $\theta$ can also be referred to as the elevation, or zenith, angle of a wave path and the angle $\phi$ can be referred to as the azimuthal angle of the wave path. The distance $\rho$ is often referred to as the range of the target. It is easily recognized that for a given elevation angle $(90-\theta)$ a particular surface can be described by rotating the azimuthal angle, $\phi$, from 0° to 360°. For example, when $\theta$ is equal to 90° the horizontal surface plane including the origin is described. Such a plane can be referred to as an azimuthal or $\phi$ plane. Similarly, by holding the angle $\phi$ to a single value, an elevation plane can be described.

In order to fully appreciate the impact of the present invention, it is desirable to review the radiation characteristics of an above-ground dipole antenna as well as the radiation patterns of a single subsurface dipole antenna.

Depending upon the desired polarization of the radiation desired, above-the-ground dipole antennas generally comprise physically different dipole elements. For example, dipoles arranged either horizontally, or vertically, above-the-ground, respectively, provide horizontally or vertically polarized modes of radiation. Further, as well known, the far-field pattern of an above-the-ground dipole antenna is the composite of the direct field pattern and the reflected field pattern, i.e. that radiation due to the reflection from the ground. This reflected radiation is often referred to as originating from an image antenna.

Figure 2:
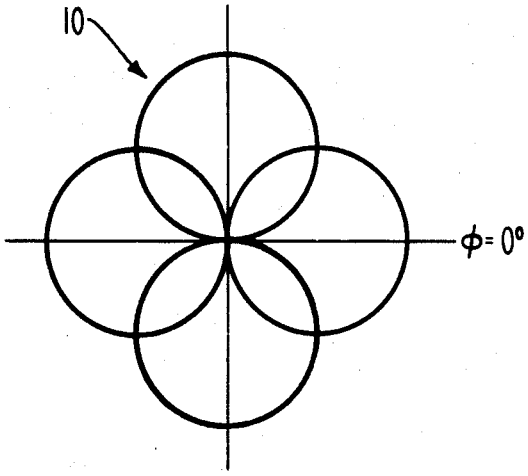
FIG. 2 is the azimuthal radiation pattern of a single subsurface dipole radiation element.

A dipole antenna which is buried in the earth substantially horizontally with the surface thereof has no far-field image antenna radiation component. That is, the far-field radiation pattern comprises only the forward, or direct, radiation from the antenna. Further, all subsurface dipole antennas must utilize one basic physical type of element since it is impractical to position a subsurface dipole vertically because of the variation of depth between the surface and points along the antenna. When viewed at a particular angle $\theta$ and at a distance $\rho$, for example on the earth's surface, i.e. $\theta=90$, the radiation pattern, shown at 10 in FIG. 2, of a single, center-fed, half-wave, subsurface dipole 12, has the general shape of a cloverleaf and is substantially omnidirectional.

Figure 3A:
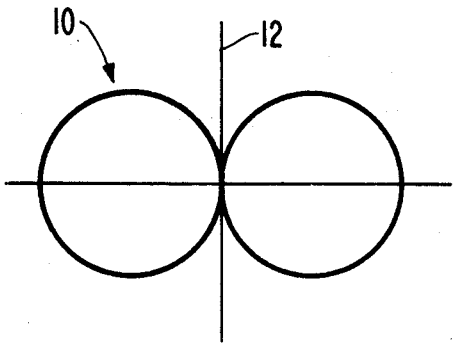
FIG. 3A is the azimuthal radiation pattern of the $E_\phi$ polarization component of the pattern shown in FIG. 2.
Figure 3B:
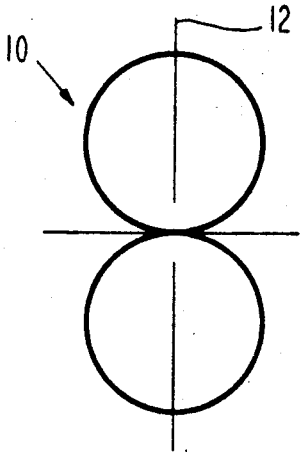
FIG. 3B is the radiation pattern of the $E_\theta$ polarization component of the pattern shown in FIG. 2.

The cloverleaf radiation pattern can be viewed as the composite of two components, one for a horizontal polarization component, $E_\phi$, parallel to the dipole 12, separately shown in FIG. 3A, and one for a pseudo-vertical polarization component, $E_\theta$, separately shown in FIG. 3B. The term "pseudo-vertical polarization" is used herein to refer to the E-field radiation component of the buried dipole 12 which is mutually orthogonal to the horizontally polarized component and to the direction of propagation and which is in the vertical plane of the propagation path. While this component is not strictly technically a vertically polarized radiation mode, it nevertheless is naturally present and must be considered in any discussion of pattern directivity or radiation suppression. Further, it should be noted, the pseudovertical polarization component is absent when the horizontal radiating element is positiond above the ground.

Figure 4A:
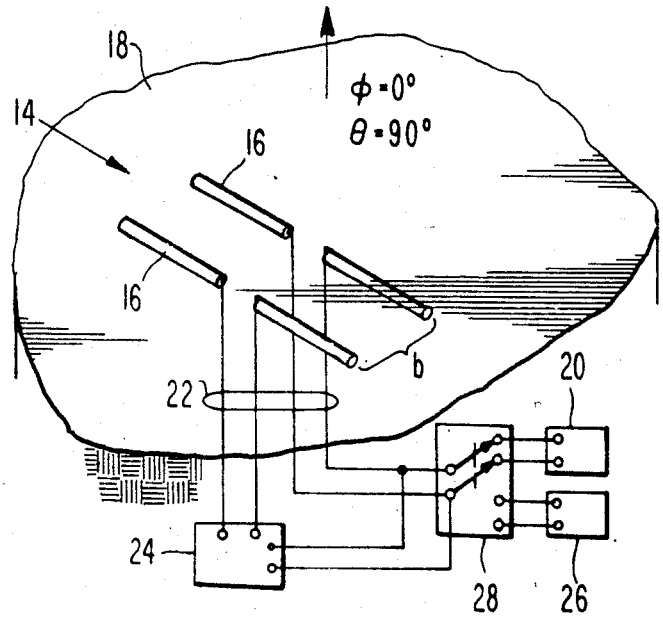
FIG. 4A is a pictorial representation of one subsurface antenna system embodying the principles of the present invention.

A subsurface antenna system, indicated generally at 14 in FIG. 4A and embodying the principles of the present invention, comprises at least one pair of radiating elements 16 buried beneath the surface 18 of the earth (also referred to as semi-infinite dissipation medium) and lying in a plane generally horizontal with the surface 18. The elements 16 are buried about the same depth below the earth's surface and conductors are parallel to the earth's surface. The surface need not be a hill or mound or special rock as discussed in cited Harmon (U.S. Pat. No. 3,346,864) or Kopf et al. (U.S. Pat. No. 3,803,616). Preferably the surface is generally a flat plane and the antenna elements 16 are parallel to that plane. Although the following description specifically refers to the elements 16 as dipoles, it should be clearly understood that other types of antenna elements can also be used. In what may perhaps be the simplest configuration, the system 14 comprises elements 16 which are open-end (not grounded), center-fed, half-wave dipoles.

Figure 4B:
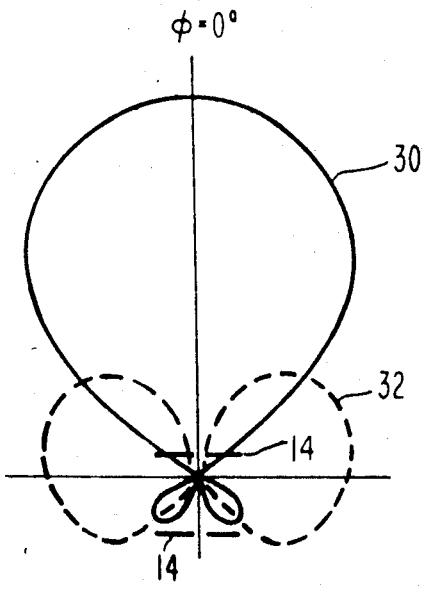
FIG. 4B is a graphic representation of the azimuthal radiation pattern of the system of FIG. 4A.
Figure 4E:
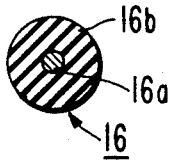
FIG. 4E is a cross section of one of the dipole elements in FIG. 4A.

The dipoles comprise a pair of colinear conductors with each of the conductors 16*a* as shown in FIG. 4E totally covered with insulator material 16*b*. Preferably the ratio of insulator diameter to conductor diameter for a typical dipole using insulator material of a dielectric constant of 2.23 is from 3.5 to 1 to 20 to 1. A typical example of a dipole is one made from standard RG59 coax line with polyethylene insulation and the outer conductor is stripped away. In addition, the elements 16 are parallel and adjacently aligned. As more fully discussed below, the dipole elements 16 are spaced apart by a distance "b" which is related to the free space wavelength ($\lambda_0$) of the electromagnetic wave to be transmitted or received, even though the wavelength ($\lambda_c$) on a physical element in the earth is actually less than the free space wavelength ($\lambda_0$).

The system 14 further includes means 20 for applying signals to the elements 16. The means 20 can include any known signal generating source, such as any conventional radio frequency (RF) transmitter and feed lines 22. Preferably, in the embodiment wherein the elements 16 are open-end, half-wave dipoles the means 20 is coupled, via the feed lines 22, to the center of each element 16. Further, the means 20 is such that the elements 16 can be excited either in phase or with a preselected relative phase angle between them. The system 14 also includes a means 26 for detecting signals which impinge on the radiating elements 16. The detecting means 26 can be any receiver configuration known in the art which is functional at the operating frequencies of the system 14. Further, the means 26 is capable of receiving signals either in phase or with a preselected phase angle which can be introduced by the phase determining means 24. The phase determining means can be any known phase shifter which is preferably a variable phase shifter. In addition, a means 28 can be provided to switch the elements 16 between the signal means 20 and the detecting means 26. The means 28 can be any known transmit/receive switch.

The radiating elements 16, when subterranean, are preferably buried at a depth of about one meter. Although the elements 16 can be at other depths, the one meter distance is selected because one meter permits the land above it to be farmed, and is undisturbed by heavy vehicles, such as trucks, passing thereover. Further, elements placed at a depth of one meter from the surface 18 of the earth and operated at high frequency, i.e. between 10 KHz and 30 KHz, sustain negligible attenuation.

The actual physical length of the buried dipole wavelength, $\lambda_c$, is determined from the normalized complex propagation constant of the dipole. The normalized complex propagation constant $\beta/\kappa_0$ is defined by the formula:

$$\Gamma/\kappa_0=\alpha/\kappa_0+j\beta/\kappa_0$$

wherein:

$\kappa_0$ is the free space wave number, equal to $2\pi/\lambda_0$ $\alpha$ is the attentuation constant of the dipole; and $\beta$ is the dipole wave number which is equal to $2\pi/\lambda_c$.

From these formulas it can readily be determined that:

$$\beta/\kappa_0=\lambda_0/\lambda_c.$$

Typically, for frequencies between 10 KHz and 30 MHz, the factor $\beta/\kappa_0$ is between about 2.5 and about 4.5. Thus, the length of the dipole is easily calculated; and in the case of a half-wave dipole is usually between from $\lambda_0/9$ and $\lambda_0/5$.

In order to fabricate an antenna system which suppresses undesired radiation and enhances radiation in a desired direction, the elements 16 must be cooperatively spaced apart. The elements 16, once the spacing is fixed, are then excited to most effectively suppress and/or enhance certain radiation components. The spacing "b" between the elements 16 determines the angle of maximum directivity of the radiation pattern desired. In this embodiment, wherein the elements 16 are parallel and adjacently aligned, the $E_\phi$ field can be made azimuthally unidirectional by exciting the elements 16 90° out of phase. The element spacing "b", the operating frequency $f_0$ and the directed angle, are related in this case by the formula:

$b=(\lambda_0/4)/\sin\theta_0$ wherein:

b = the element spacing;

$\lambda_0$ = the free space wavelength of the radiation which, as well known, is related to the free space frequency ($f_0$) by the formula $c=\lambda_0 f_0$ wherein c is the speed of light; and $\theta_0$ = the zenith angle of the directed radiation pattern.

Figure 4C:
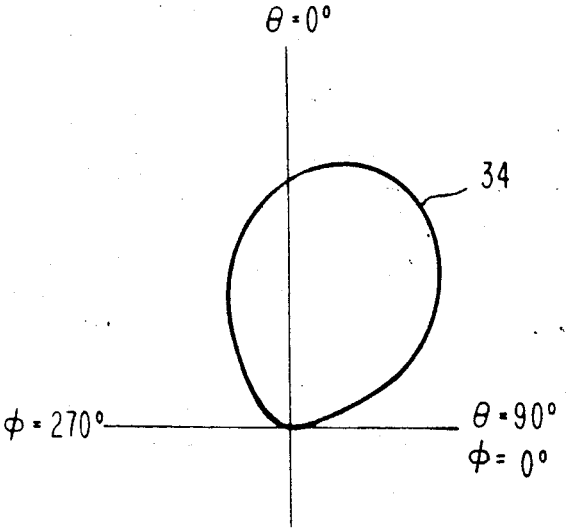
FIG. 4C is a graphic representation of the radiation pattern in the $\phi=0$ plane of the system of FIG. 4A.

The convention adopted herein or describing a radiation pattern is to position the azimuthal origin, $\phi=0$, on the centerline of the array in the direction of maximum radiaton. In addition, for clarity and where appropriate, all elements of the systems discussed hereinafter are considered to be excited with signals of equal amplitude. All elements discussed herein are totally electrically insulated from the surrounding semi-infinite dissipative medium as described previously in connection with FIG. 4E. Referring back to the system 14 embodiment depicted in FIG. 4A wherein the radiating elements 16 are parallel and adjacently aligned, the resultant azimuthal radiation pattern of the horizontally polarized field component in the $\theta=90°$ plane which is produced when $b=\lambda_0/4$ and when the elements 16 are excited 90° out of phase is shown in FIG. 4B. This pattern, where $\theta=90$, is commonly referred to as the ground wave radiation pattern. The solid line 30 represents the dominant radiating pattern and the dashed line pattern 32 represents, in this case, the lateral radiation. FIG. 4C is the elevation pattern 34 in the $\phi=0$ plane. As depicted in FIG. 4B the radiation pattern 30 is substantially unidirectional and maximum directivity is achieved when the radiating elements are excited with a 90° phase difference. The spacing "b" and difference in phase excitation between the elements 16 are chosen to suppress the undesired modes, i.e. radiation in the $\phi=270°$ direction which also enhances the directed mode.

Figure 4D:
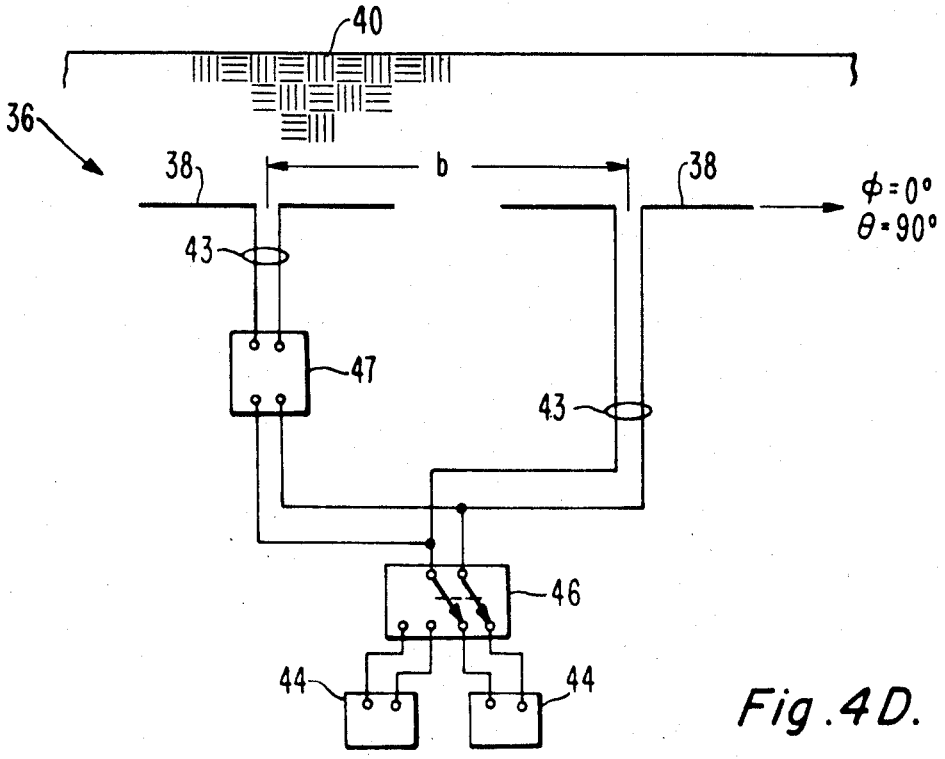
FIG. 4D is a pictorial representation of a subsurface antenna system which is the equivalent of the system shown in FIG. 4A.

Another system embodiment is depicted generally at 36 in FIG. 4D. The system 36 comprises a pair of elements 38 like those in FIGS. 4A and 4E buried beneath the surface 40 of the earth but arrayed linearly in an end-to-end fashion. The centers of the elements 38 are spaced apart by the distance "b" the system 36 further includes means 42 for applying signals to the elements 38 via feed lines 43, means 44 for detecting signals thereon also via feed lines 43 and means 46 for switching between the signal and detecting means 42 and 44 respectively. In addition, the system 36 also includes means 47 for adjusting the relative phase difference between the elements 38. The radiation pattern of the $E_\theta$ field of the system 36, when the elements 38 are excited 90° out of phase and spaced the same as the elements 16 is substantially identical to the radiation pattern 30 of the system 14. Further, when the linear alignment of the system 36 is oriented perpendicular to the length of the elements 16 of the system 14, the orthogonally polarized radiation pattern of the two systems 14 and 36 are directed in the same azimuthal and elevation planes.

Figure 5A:
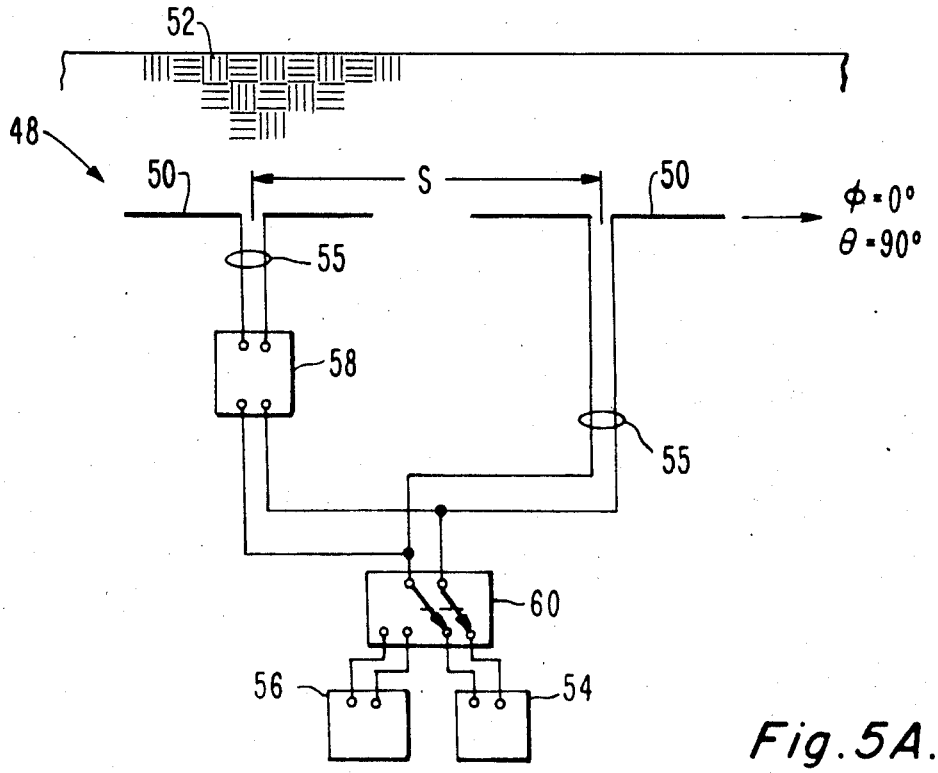
FIG. 5A is a pictorial representation of another subsurface antenna system embodying the principles of the present invention.

While the above system, 14 and 36, provide a unidirectional azimuthal radiation pattern they nevertheless produce lateral radiation components 32 that are excessive for many applications. A basic system configuration 48, which is shown in FIG. 5A, provides excellent suppression of the lateral radiation. The system 48 includes a pair of in-phase radiating elements 50 buried beneath the surface 52 of the earth and oriented in a generally horizontal position with respect to that surface 52. the system 48 also includes conventional signal applying means 54 and feed lines 55, detection means 56, phase determining means 58 and switching means 60. Preferably, the elements 48 are open-end, center-fed, half-wave dipoles like those in FIGS. 4A and 4E. In this embodiment, the elements 48 are colinear. The centers of the elements 48 are spaced apart by a distance "s" which is defined by the formula:

$$s=(\lambda_0/2)/\sin\theta_0$$

wherein:

s=the element spacing;

$\lambda_0$=the free space wavelength of the radiation; and $\theta_0$=the angle of maximum radiation suppression.

Figure 5B:
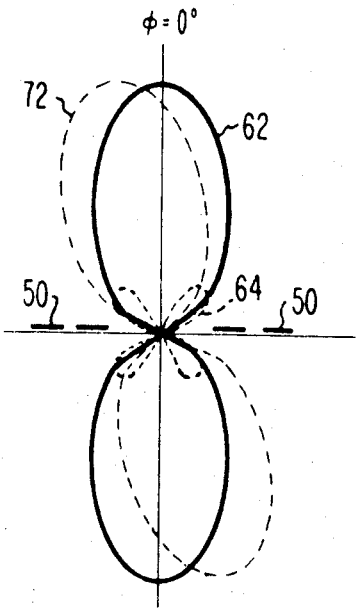
FIG. 5B depicts the azimuthal radiation pattern in the $\theta=\theta_0$ surface of the system shown in FIG. 5A.
Figure 5C:
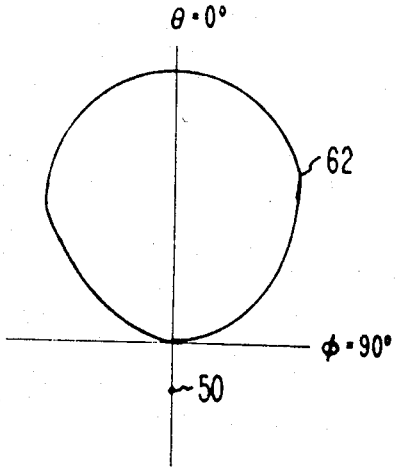
FIG. 5C depicts the radiation pattern in the $\phi=90$ elevation plane of the system shown in FIG. 5A.

The resulting $E_\phi$ radiaton pattern 62 of the system 48 is shown in FIG. 5B depicting the azimuthal or ground wave radiation pattern and 5C which depicts the elevation, or skywave, radiation pattern. As shown, when the elements 50 are excited with equal amplitude in phase, with $s=\lambda_0/2$, the lateral radiation 64 is substantially completely suppressed in the ground plane, i.e. when the zenith angle, $\theta$, is 90°. Of course, when "s" is equal to other than $\lambda_0/2$ the lateral radiation 64 shown in small dashed lines, is suppressed in the selected $\theta_0$direction.

Figure 5D:
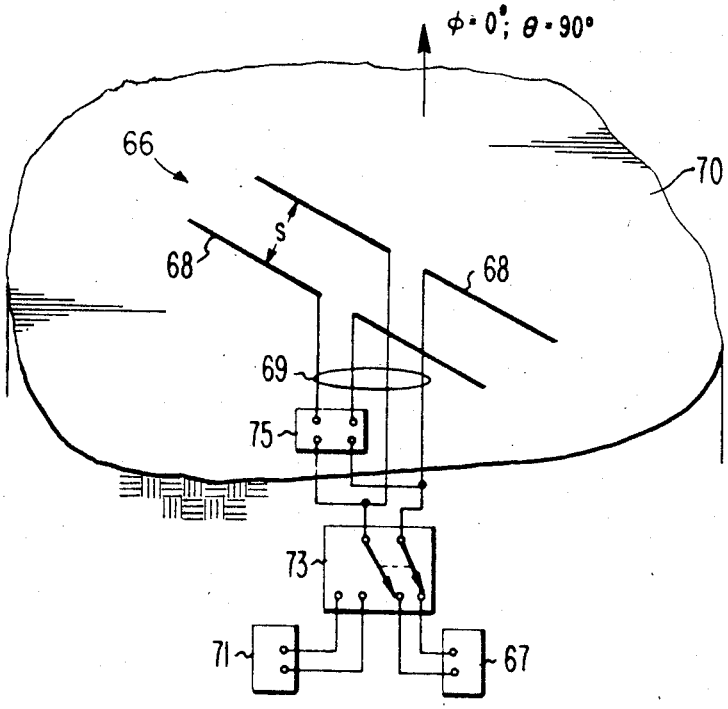
FIG. 5D is a pictorial representation of a subsurface system which is the equivalent of the system shown in FIG. 5A.

A system 66 embodiment is shown in FIG. 5D and comprises a pair of radiating elements 68 buried beneath the surface 70 of the earth. In this system 66, the elements 68 are dipoles such as those described for use in the system 48 but in this instance they are positioned parallel and adjacently aligned to each other for suppression of horizontally polarized radiation. The system 66 includes means 67 for applying signals to the element 68 and coupled thereto via feed lines 69. In addition, the system 66 includes means 71 for detecting signals impinging on the elements 68, means 73 for switching the elements 68 between the signal means 67 and the detecting means 71 and means 75 for maintaining a relative phase difference between the elements 68. When these elements 68 are oriented perpendicular to the colinear direction of the elements 50 and are excited in phase, the radiation patterns of the two systems 48 and 66 are substantially identical but with orthogonal polarization.

The pointing angle, i.e. the direction of the maximum radiation of the systems described herein, can be steered by varying the relative phase of the excitation between the elements, i.e. the systems described herein can be operated as subsurface phase array antennas. To clarify this point, and for examplary purposes, it is advantageous to consider the array factor of the system 48 shown in FIG. 5A. The array factor (AF) for this system 48, is the mathematical basis used to determine the effects of arraying the radiating elements 50. That is, the array factor is a known quantity representing the modification of the radiation patterns resulting from placing one or more radiating element near another radiating element. For the system 48, the array factor is mathematically defined by the formula:

$$AF = 2\cos\left[\frac{\pi}{2}\left(\frac{1}{\sin\theta_0}\sin\theta\sin\theta - \frac{2}{\pi}\psi\right)\right]$$

wherein $\psi$ represents the relative phase angle between the excitations of the elements 50.

The pointing angle of the maximum radiation is determined when the argument of the array factor is equal to zero, i.e. when:

$$\psi = \frac{\pi/2}{\sin\theta_0}(\sin\phi\sin\theta).$$

From this formula it is easily observed that the pointing angle which occurs at $\phi=0$ and $\phi=180°$ when the elements 50 are driven in phase, can be varied by varying the relative phase angle $\psi$ of the element excitation. In the instance where $\theta_0=90°$ and $\theta=90°$ the pattern 62 is steered in azimuth. Such a steered radiation pattern 72 is shown by long dashed lines in FIG. 5B.

While the system 14 and 36 are primarily designed to provide a unidirectional radiation pattern from an array of buried dipoles and the system 48 and 66 are primarily designed to suppress lateral radiation from a subsurface array, both retain a substantially uncontrolled elevation radiation pattern. It is often desired to suppress the vertical radiation from a subsurface antenna to provide a more secure communication network.

Figure 6A:
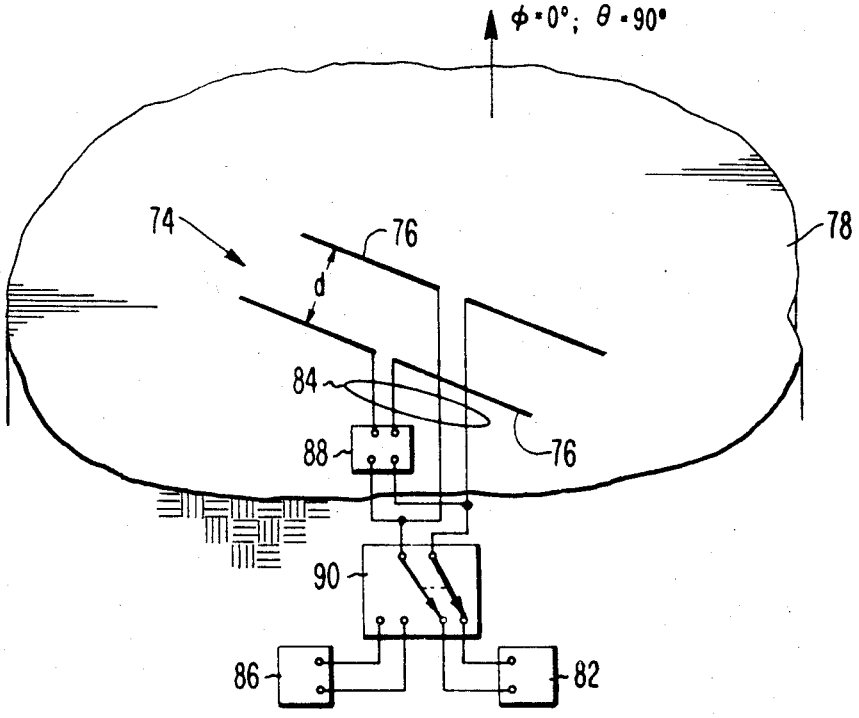
FIG. 6A is a pictorial representation of a third subsurface antenna system embodying the principles of the present invention.

A particular system embodiment which accomplishes this goal is generally indicated by the numeral 74 in FIG. 6A. The system 74 comprises a pair of radiating elements 76 buried beneath the surface 78 of the earth. The elements 76 are, for example, open-end, center-fed, half-wave dipole antennas like that described in connection with FIGS. 4A and 4E. The elements 76 are spaced apart by a distance "d" and are arrayed, i.e. in this case parallel and adjacently aligned. The distance "d" is defined by the formula:

$$d=(\lambda_0/2)\sin\theta_0$$

wherein the angle $\theta_0$ represents the angle of maximum directivity. Preferably, the elements 76 of the system 74 are excited in phase opposition. In addition to achieving vertical or elevation radiation suppression, the system 74 also effectively suppresses lateral radiation.

Figure 6B:
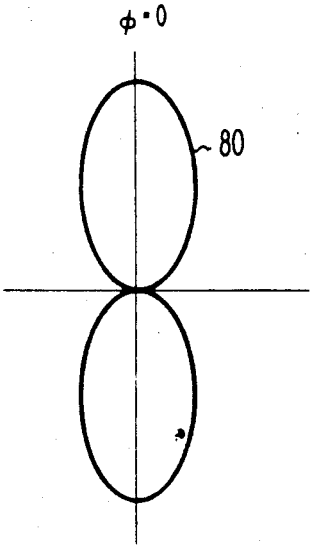
FIG. 6B is the azimuthal radiation pattern of the system of FIG. 6A as viewed in the $\theta=\theta_0$ plane.
Figure 6C:
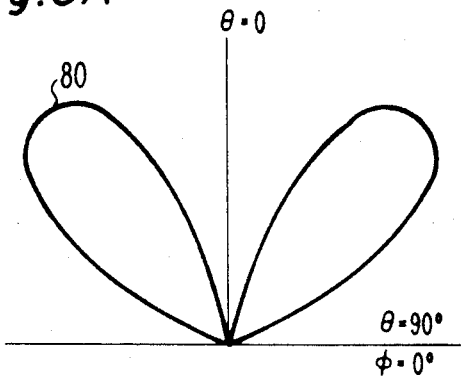
FIG. 6C is the elevation radiation pattern of the system of FIG. 6A in the $\phi=0$ plane.

The radiation pattern 80 which results from the system 74 is shown in FIG. 6B, which represents the azimuthal pattern, and FIG. 6C which represents the elevation pattern. Conventional means 82 for applying signals to the elements 76 via feed lines 84, signal detecting means 86, phase determining means 88 and switching means 90 are included in the system 74.

Figure 6D:
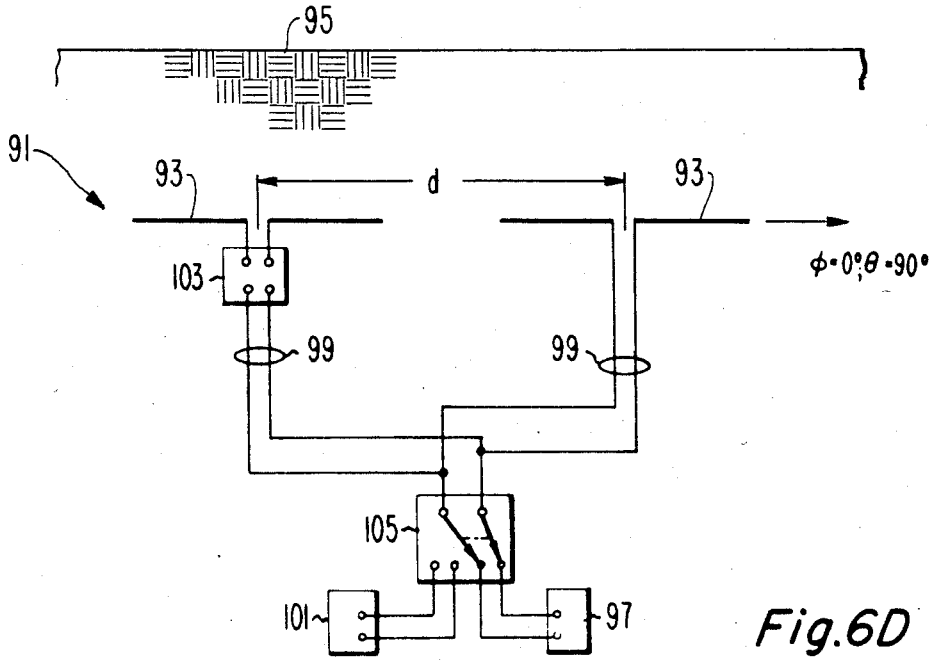
FIG. 6D is a pictorial representation of a subsurface system which is the equivalent of the system shown in FIG. 6A.

A system 91 complementary to the system 74 is shown in FIG. 6D and comprises elements 93 buried beneath the surface 95 of the earth are, for example, dipoles like that discussed in connection with FIGS. 4A and 4E. The elements 93 are colinearly aligned. As above, the system also includes means 97 for applying signals to the elements 93 via feed lines 99, means 101 for detecting signals on the elements 93, means 103 for controlling the phase of signals between the elements 93 and means 105 for switching between the signals applying means 97 and the signal detecting means 101. The elements 93 are spaced apart on centers by a distance "d" defined above.

It will be readily understood by those knowledgeable in the antenna art that the principles of the above system can be applied to produce any number of composite systems. A number of such composite systems, which exhibit improved radiating capabilities, are discussed hereinafter.

Figure 7A:
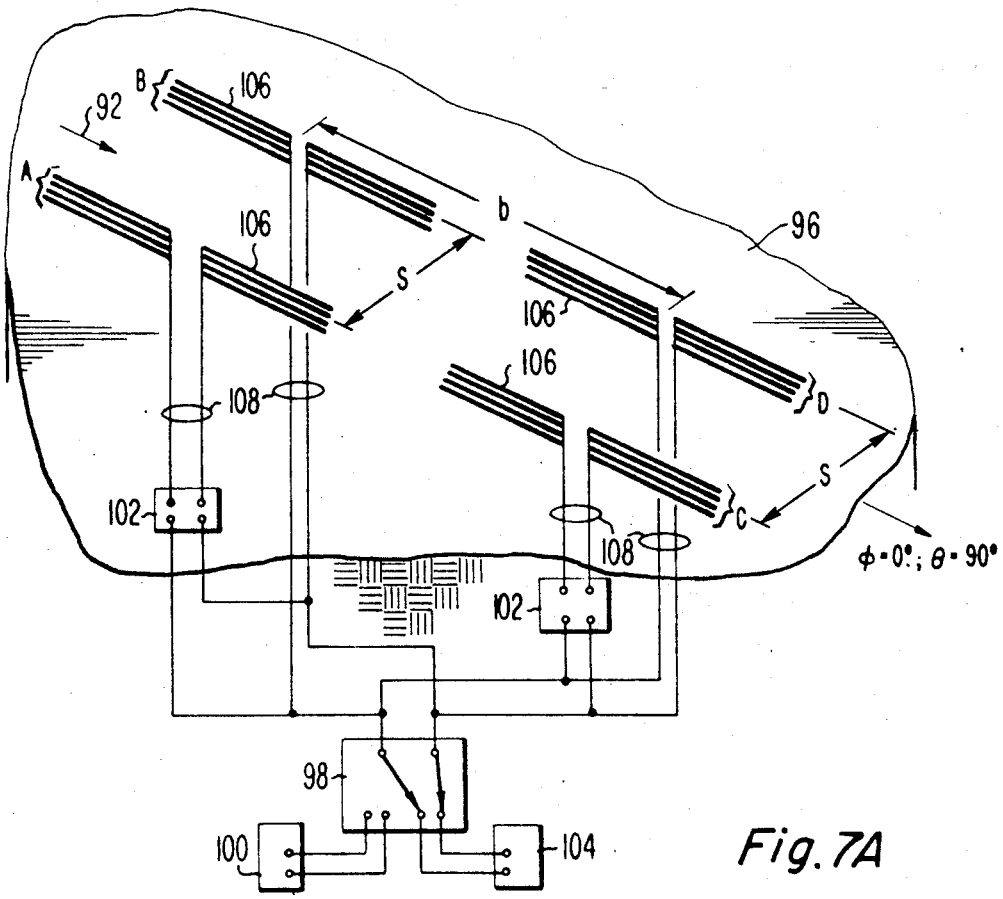
FIG. 7A is a pictorial view of a subsurface antenna system embodying the principles of the present invention.
Figure 7B:
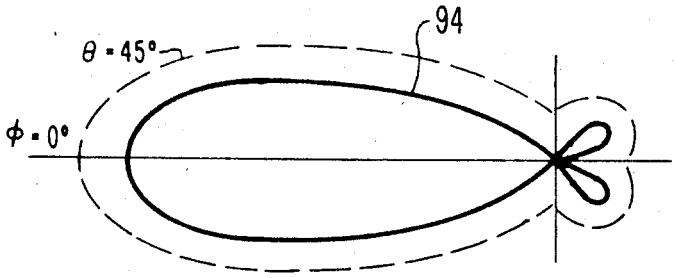
FIG. 7B is the azimuthal radiation pattern of the system shown in FIG. 7A in the $\theta=\theta_0$ plane.
Figure 7C:
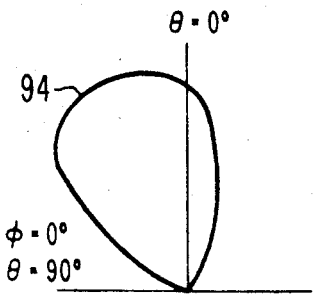
FIG. 7C is the elevation radiation pattern of the system shown in FIG. 7A in the $\phi=0$ plane.

One such composite system embodiment 92, which exhibits an enhanced efficiency is shown in plan view in FIG. 7A and has a resultant radiation pattern 94 as depicted in FIGS. 7B and 7C.

The system 92, buried beneath the surface 96 of the earth can be thought of as a combination of systems 36 and 66. The system 92 comprises switching means 98, detecting means 100, phase determining means 100 and means 104 for applying signals to elements 106 via feed lines 108. Further, using known techniques, the efficiency of each open-end, center-fed, half-wave dipole element 106 can be effectively improved by relaxing it with a plurality of relatively closely spaced parallel driven elements. The dipole elements 106 are each insulated from the medium as shown in FIG. 4E. Thus, as shown in FIG. 7A, each group of dipoles, A, B, C and D, is electromagnetically effectively a single dipole. In addition, the dipoles comprising groups A and B are parallel and adjacently aligned and spaced apart on centers by a distance "s" as defined above. The groups C and D are also parallel and adjacently aligned and spaced apart on centers by a distance "s" as deifined above. Further, the groups A and C and B and D are, respectively, colinear with their centers being spaced apart by a distance "b" as defined above. The groups A, B, C and D of elements 106 are excited in accordance with the above described arrays 36 and 66. The resulting radiation pattern 94 is depicted in FIGS. 7B and 7c. Referring particularly to FIG. 7B, the solid line represents the azimuthal pattern in the $\theta=\theta_0$ plane, e.g. $\theta_0=74°$ and the dashed pattern represents the pattern in the $\theta_0=45°$ plane. It should be understood that by varying the relative phase of the excitation with which the elements 106 are driven, the radiation pattern 94 can also be steered.

Figure 8A:
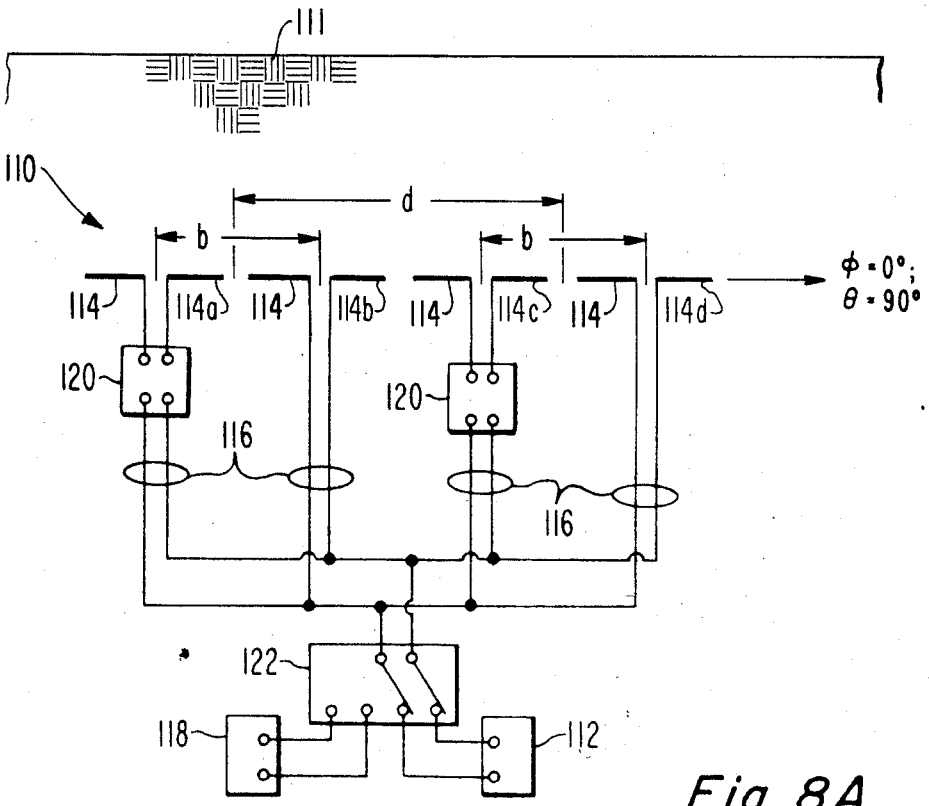
FIG. 8A is a pictorial view of yet another subsurface system embodying the principles of the present invention.
Figure 8B:
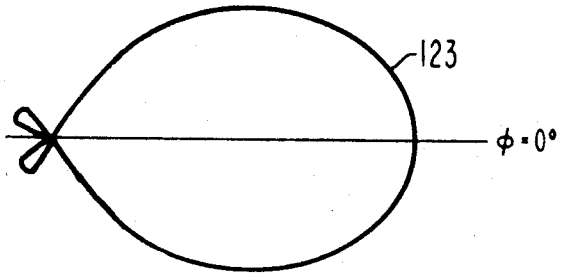
FIG. 8B represents the azimuthal radiation pattern of the system shown in FIG. 8A.
Figure 8C:
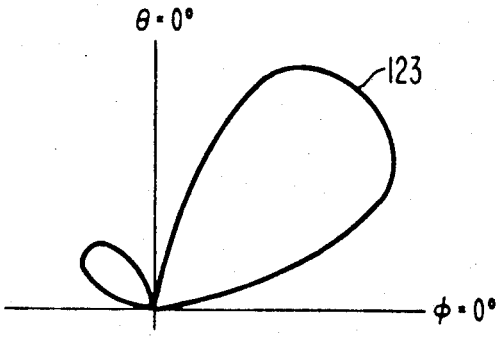
FIG. 8C represents the elevation radiation pattern of the system shown in FIG. 8A.

A second composite system embodiment 110 is shown in FIG. 8A and can be considered a combination of the previously discussed array 36 and the above-mentioned system 91. Again, the means 112 for applying signals to elements 114 of the system 110 via feed lines 116, detecting means 118, phase determining means 120 and the switching means 122 can be conventional equipment. In the system 110, the elements 114 buried beneath the surface 111 of the earth are single open-end, center-fed, half-wave dipoles totally insulated from the medium as shown in FIG. 4E, although increased efficiency can be obtained by implementing known techniques of element grouping as describd in the system 92 above. As shown, all of the elements 114 are colinar with elements 114A and 114B and are spaced apart by a distance "b" as defined above. In addition, elements 114C and 114D similarly spaced apart. Further, the pair of elements 114A and 114B and the pair of elements 114C and 114D are spaced apart by a distance "d" as defined above. The elements 114A and 114B of the one pair, and the elements 114C and 114D of the other pair are preferably excited in accordance with the above described array 36. The element pairs, 114A/114B and 114C/114D are excited in accordance with the above-described array 91. The radiation pattern 123 of the system 110 is depicted in FIGS. 8B and 8C.

In secure communications systems, it is often desirable to transmit in a single direction and receive signals from another direction while minimizing the susceptability of the system to interference. A composite subsurface system embodiment 124 which accomplishes these goals for groundwave radiation and low angle spacewave radiation, i.e. where $\theta$ is large, is shown in plan view in FIG. 9A, As shown, the system 124 comprises sixteen open-end, centerfed, half-wave dipoles 126 insulated from the medium as illustrated in FIG. 4E. In this instance, each dipole element 126 is represented by a single line. The elements 126 are arrayed in the form of eight spaced doublets 128, each doublet 128 being driven from a single junction box 130 which, for example, can be used for transmit/receive mode reversal.

For clarity, the eight spaced doublets 128 are divided into two sub-arrays 132 each comprising four of the doublets 128. Since the sub-arrays 132 are identical, only the details of one will be discussed hereinafter. Each sub-array 132 comprises two pairs of colinar doublets 130. The colinear doublet members of each pair are preferably spaced on centers by the distance "b" and excited in phase quadrature as in the previously described array 36. These colinear pairs of dipoles in turn are parallel and adjacently aligned and are spaced apart on centers by the distance "s" as in the previously described array 66. Opposite parallel doublets are excited in phase with each other, as in the array 66, through, for example, equal lengths of transmission feed line 134. All four such lines in the array 124 are preferably of equal lengths to preserve the phase relationships among the array voltages as introduced by networks or other means at the transmitter/receiver means which is represented by a central junction box 136.

During the receive mode, the means 126 of each doublet 128 are excited in phase opposition as in the previously-described complement of the system 91 for enhanced suppression of undesired radiation. The voltage available at the receiver in the central junction box 136 from either sub array 132 together with its phasing network is the sum of the eight dipole output voltages each modified by a phase angle as described above and for which relative values are shown opposite R in FIG. 9A. When $b=\lambda_0/4$ and $s=\lambda_0/2$ the azimuthal pattern for the quasi-vertically polarized ground wave and the low-angle, i.e. large $\theta$, spacewave is directed toward $\phi=0$ and most other radiation is substantially completley suppressed. However, a high-angle forward-directed spacewave component remains.

Element for element, each sub-array 132 is excited in phase with the other sub-array 132. The two sub-arrays 132 are spaced apart by a distance "d" such that:

$$d=(\lambda_0/2)/\sin\theta_0$$

wherein $\theta_0$ is th angle at which radiation from one of the two sub-arrays 132 cancels that of the other in the vertical plane of the $\phi=0°$ or $\phi=180°$ plane. The distance "d" is chosen to place this suppression in the center of the remaining above-described high angle spacewave component.

Figure 9A:
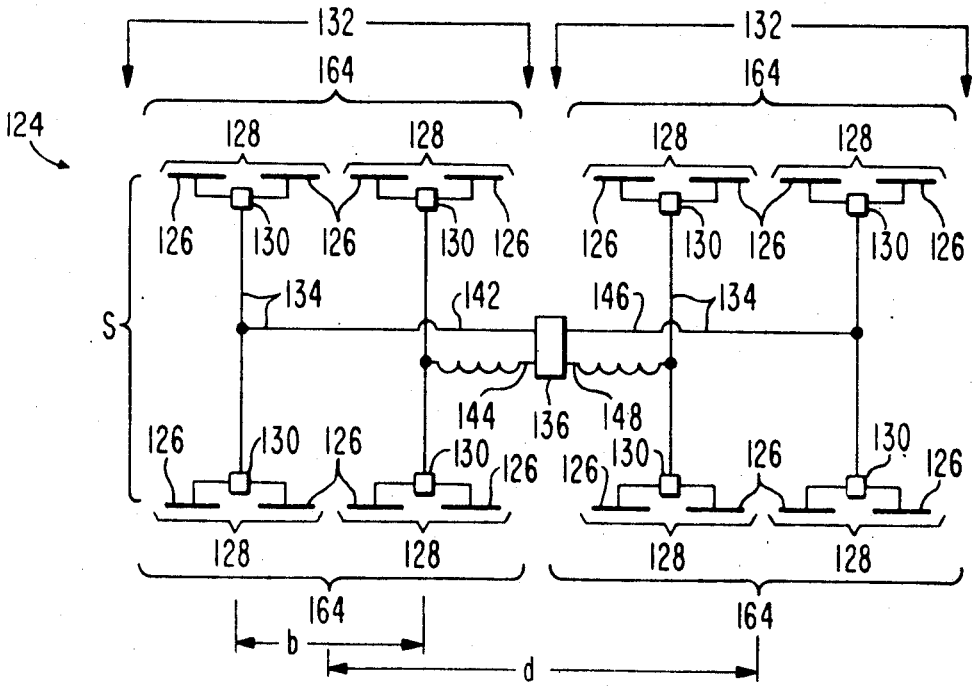
FIG. 9A is a pictorial view of still another subsurface antenna system embodying the principles of the present invention.
Figure 9B:
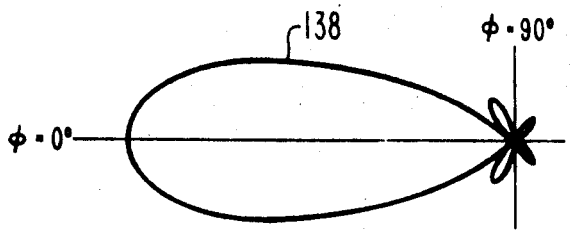
FIG. 9B represents the azimuthal radiation pattern in the $\theta=90°$ plane of the system shown in FIG. 9A.
Figure 9C:
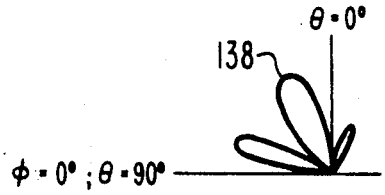
FIG. 9C is the elevation radiation pattern in the $\phi=0$ plane of the system shown in FIG. 9A.

The output voltages of the two sub-arrays 132 are added at the central junction box 136 to produce the resultant receiving pattern 138 depicted in FIG. 9B and FIG. 9C, which represent the aximuthal pattern and the elevation pattern respectively.

The transmitting pattern 140 of the system 124 as described heretofore is the same as the receiving pattern and can be reversed in direction by reversing the sense of the quadrature relationship in the array 66 from lag to lead. However, this reduces the transmitting efficiency. To maximally increase the transmitting efficiency for the surface wave or low-angle spacewave, the elements 126 of each doublet 128 are reconnected via the junction boxes 130 so that they are excited in phase with each other rather than in phase opposition. Additionally, a phase lag $\psi$ can be introduced in the excitation to one of the sub-arrays 132, for example in each of the outputs 142 and 144, such that:

$$\psi=2\pi[1-1/(2\sin\theta_0)].$$

Figure 9D:
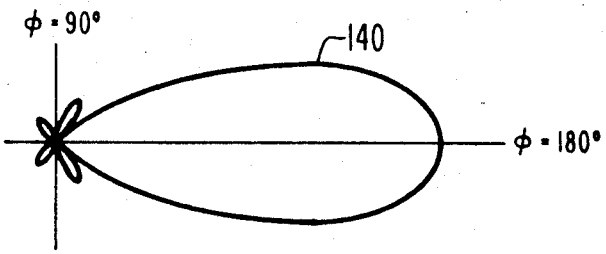
FIG. 9D is the radiation pattern in the $\theta=90°$ plane of the system shown in FIG. 9A.

The sum of the delay $\psi$ so defined and the propagation delay due to the separation d is equal to 360°. As a result, the radiation to the right of the system 124 from the one sub-array 132 is in phase with the radiation from the other sub-array 132. For transmission to the right the phase relationships among the dipole excitations, exclusive of $\psi$, have the relative values as shown opposite T in FIG. 9A. The transmitting pattern 140, shown in FIG. 9D, has essentially the same shape as the receiving pattern FIG. 9B.

The junction boxes 130 used to accomplish array switching can be operated remotely via a D.C. voltage superimposed on a balance coaxial transmission lines 142, 144, 146 and 148 and the central junction box 136.

Figure 10A:
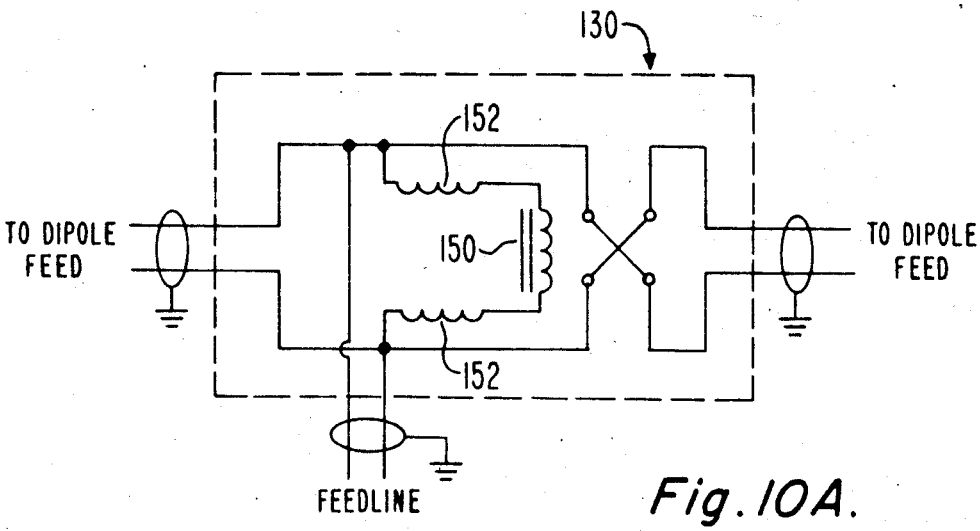
FIG. 10A is a schematic view of a junction box usable in the system shown in FIG. 9A.

One form of the junction box 130 is shown in FIG. 10A. Therein a polarity sensitive D.C. reversing relay 150 is isolated from radio-frequency currents by the blocking chokes 152 and maintains one position or the other according to the priority of the D.C. voltage maintained across the two conductors of the incoming feedline. In the receiving mode the two dipoles 126 of a doublet 128 are connected out of phase with each other and in the transmission mode they are connected in phase with each other.

Figure 10B:
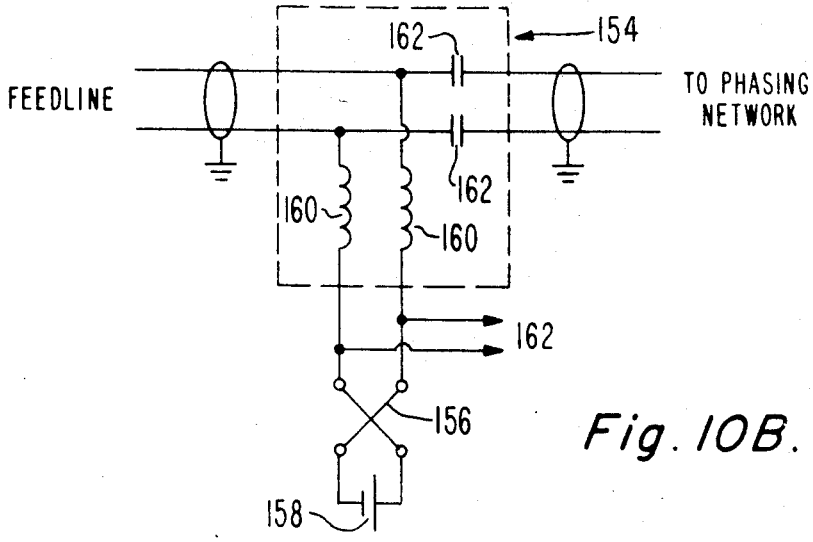
FIG. 10B is a schematic view of a DC isolator used in conjunction with the sytem shown in FIG. 9A.

The D.C. switching voltage is impressed on each of the four transmission lines that connect at 142, 144, 145, 148 in FIG. 9A by means of a D.C. isolator, one type of which is shown at 154 in FIG. 10B. A receiving switch 156 via a battery 158 and blocked to radio-frequency currents by a choke 160, is connected with one polarity for receiving, or its reverse for transmitting, across the conductors of the particular transmission line connected to the isolator 154. The D.C. voltage is isolated from the transmitter or receiver circuts by blocking capacitors 162. The same switching voltage is applied in parallel at 162 to the other three identical isolators.

Figure 11A:
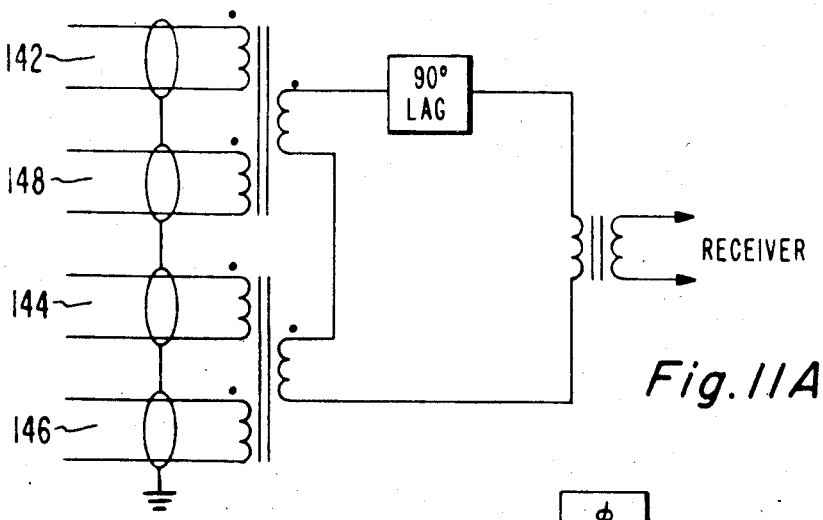
FIG. 11A is a schematic view of a portion of a receiving circuit useful in conjunction with the system shown in FIG. 9A.
Figure 11B:
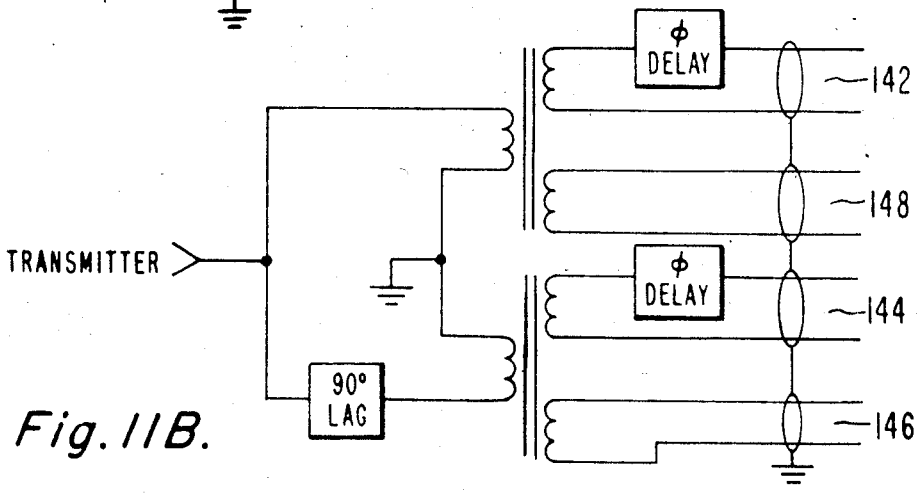
FIG. 11B is a schematic view of a portion of a transmission circuit useful in conjunction with the system shown in FIG. 9A.

Preferably, phase shifts for beam forming are introduced at the central junction box 136 and can be provided by conventional techniques. One such conventional technique for the receiving mode is shown in FIG. 11A, wherein the transmission feed lines designated in 142, 144, 146 and 148 in FIG. 9A are connected to corresponding numbered input circuits. When the junction boxes 130 are switched to the receiving positions, the circuit schematically shown in FIG. 11A sums all of the system element voltages to provide the phase relationships shown opposite R in FIG. 9A for each of the four identical colinear subarrays 164. A similar means for the transmission mode is schematically shown in FIG. 11B when the junction boxes 130 are switched to the transmitting position, the circuit shown in FIG. 11B causes the elements 126 of the array 124 to be excited with currents having the previously-described phase relationship for efficient transmission.

It will be understood that other combinations of the basic systems described in detail herein can be made and that the embodiments described herein are merely exemplary and are not limiting.

The subsurface systems described herein provide a means for selectively controlling high frequency, i.e. between 10 KHz and 30 MHz, radiation of subsurface, or buried, radiation elements. These systems demonstrate a new design flexibility in this field and provide both radiation suppression and directed radiation which can be steered by controlling the phase difference between the individual element excitations.

What is claimed is:

1. A subsurface antenna system having a radiation pattern exhibiting improved directivity in the free space above a subsurface comprising:

first and second radiation elements identically oriented and buried within a semi-infinite dissipative medium and adapted to radiate signals at a frequency in free space adjacent said semi-infinite dissipative medium;

means coupled to said radiating elements for applying said signals with a selected relative phase therebetween;

said radiating elements comprising conductors totally covered with insulating material so that said conductors are totally insulated from the medium;

said radiating elements having their respective centers spaced apart by at least one quarter free space wavelength of said frequency; and said spacing and relative phase being further chosen to enhance the desired directivity of said antenna in free space.

2. A subsurface antenna system as claimed in claim 1 wherein said radiating elements are each open-end, center-fed, half-wave dipoles comprising a pair of conductors covered with insulator material.

3. A subsurface antenna system as claimed in claim 2 wherein the insulator material has a dielectric constant of generally about 2 and the thickness of the insulator material is such that the ratio of the insulator diameter to conductor diameter is from 3.5 to 1 to 20 to 1.

4. A subsurface antenna system as claimed in claim 2 wherein said elements are substantially horizontal to said surface and lie on the same geometric plane.

5. A subsurface antenna system as claimed in claim 2 wherein said elements are parallel and adjacently aligned.

6. A subsurface antenna system as claimed in claim 5 wherein said elements are spaced apart by a distance "b" and said signals are 90° out of phase with each other, said distance "b" being defined by the formula:

$$b=(\lambda_0/4)/\sin\theta_0$$

wherein:

b=the element spacing;

$\lambda_0$=the free space wavelength of the radiation;

$\theta_0$=the zenith angle of the directed radiation, whereby the characteristc radiation pattern of said array is substantially unidirectional.

7. A subsurface antenna system as claimed in claim 5 wherein said elements are spaced apart by a distance "s" and said signals are in phase with each other, said distance "s" being defined by the formula:

$$s=(\lambda_0/2)/\sin\theta_0$$

wherein:

s=the element spacing;

$\lambda_0$=the free space wavelength of the radiation; and $\theta_0$=the zenith angle of the suppressed radiation, whereby the radiation pattern exhibits suppressed lateral radiation.

8. A subsurface antenna system as claimed in claim 5 wherein said elements are spaced apart by a distance "d", and said signals are in phase opposition with each other, said distance "d" being defined by the formula:

$$d=(\lambda_0/2)\sin\theta_0$$

wherein:

d=the element spring;

$\lambda_0$=the free space wavelength of the radiation; and $\theta_0$=the zenith angle of the maximum directivity radiation pattern, whereby the radiation pattern exhibits suppressed vertical radiation and suppressed lateral radiation.

9. A subsurface antenna system as claimed in claim 2 wherein said first and said second elements are colinear.

10. A subsurface antenna system as claimed in claim 9 wherein said elements are spaced apart by a distance "b" and said signals are 90° out of phase with each other, said distance "b" being defined by the formula:

$$b=(\lambda_0/4)/\sin\theta_0$$

wherein:

b=the element spacing;
$\lambda_0$=the free space wavelength of the radiation; and
$\theta_0$=the zenith angle of the directed radiation, whereby the resulting radiation pattern is substantially unidirectional.

11. A subsurface antenna system as claimed in claim 9 wherein said elements are spaced apart by a distance "s" and said signals are in phase with each other, said distance "s" being defined by the formula:

$$s=(\lambda_0/2)/\sin\theta_0$$

wherein:

s=the element spacing;
$\lambda_0$=the free space wavelength of the radiation; and
$\theta_0$=the zenith angle of the directed radiation pattern, whereby the radiation pattern of said array exhibits suppressed lateral radiation.

12. A subsurface antenna array as claimed in claim 9 wherein said elements are spaced apart by a distance "d" and said signals being in phase opposition with each other, said distance "d" being defined by the formula:

$$d=(\lambda_0/2)\sin\theta_0$$

wherein:

d=the element spacing;
$\lambda_0$=the free space wavelength of the radiation; and
$\theta_0$=the zenith angle of the maximum directivity of the radiation pattern, whereby the resulting radiation pattern exhibits suppressed vertica and lateral radiation.

13. A subsurface antenna system as claimed in claim 1 further comprising a third and a fourth radiating element positioned beneath said surface, said third and said fourth radiating elements being identically oriented with and positioned substantially like said first and said second radiating elements; and means coupled to said third and fourth elements for applying said signals thereto such that the relative phase of the signals between said first, said second, said third and said fourth elements is chosen to suppress undesired radiation.

14. A subsurface antenna system as claimed in claim 13 wherein said first, said second, said third and said fourth radiating elements are open-end, center-fed, half-wave dipoles comprising a pair of conductors covered with insulator material.

15. A subsurface antenna array as claimed in claim 14 wherein said first and said second radiating elements are parallel and adjacently aligned;

said third and said fourth radiating elements are parallel and adajently aligned;

all said elements lie in the same geometric plane; and said first and said antenna radiating elements are colinear with said third and fourth radiating elements respectively.

16. A subsurface antenna system as claimed in claim 15 wherein said first and second elements and said third and fourth elements are respectively spaced apart by a distance "s", said distance "s" being defined by the formula:

$$s=(\lambda_0/2)/\sin\theta_0$$

wherein:

s=the element spacing;
$\lambda_0$=the free space wavelength of the radiation; and
$\theta_0$=the zenith angle of the directed radiation pattern; and said first and third radiating elements and said second and fourth radiating elements respectively are spaced apart by a distance "b" wherein "b" is defined by the formula:

$$b=(\lambda_0/4)/\sin\theta_0$$

wherein:

b=the element spacing;
$\lambda_0$=the free space wavelength of the radiation; and
the zenith angle of the directed radiation pattern; and
said signal applied to said first radiating element being in phase with said signal applied to said second radiating element, said signal applied to said third radiating element being in phase with said signal applied to said fourth radiating element but said signals applied to said first and said second radiating elements are 90° out of phase with said signals applied to said third and said fourth radiating elements.

17. A subsurface antenna system as claimed in claim 13 wherein said first, said second, said third and said fourth radiating elements each comprise a plurality of dipoles positioned such that said plurality of dipoles effectively operate as a single dipole.

18. A subsurface antenna system as claimed in claim 14 wherein said first and said second radiating elements are colinear, and are spaced apart by a distance "b", and said signals applied thereto are 90° out of phase, said third and fourth elements are colinear and are spaced apart by a distance "b" and said signals applied thereto are 90° out of phase, said distance "b" being defined by the formula:

$$b=(\lambda_0/4)/\sin\theta_0$$

wherein:

b=the element spacing;
$\lambda_0$=the free space wavelength of the radiation,
$\theta_0$=the zenith angle of the directed radiation; and
said first and said second elements and said third and fourth elements are colinear and spaced apart by a distance "d", said signals applied to said first and second elements and said signals applied to said third and fourth elements being in phase, said distance "d" being defined by the formula:

$$d=(\lambda_0/2)\sin\theta_0$$

wherein:

d=the element spacing;
$\lambda_0$=the free space wavelength of the radiation;

$\theta_0$=the zenith angle of the directed radiation; and all said radiating elements lie in the same geometric plane and generally parallel to the surface of said medium.

19. A phase steered subsurface antenna system having a radiation pattern exhibiting the suppression of undesired natural existing radiation and a directed radiation, the pointing angle of which is selectable comprising:

at least one pair of spaced apart radiating elements buried within a semi-infinite dissipative medium and adapted to radiate signals at a frequency in free space adjacent said medium, said elements being totally electrically insulated from said medium and identically oriented and spaced apart by at least a quarter free space wavelength at said frequency in a fashion which enhances radiation in a preselected direction and suppresses radiation in other directions; and means coupled to radiating elements for applying said signals thereto, wherein the relative phase of said signals to said pair of elements of variable, whereby upon varying said relative phase, said pointing angle of said directed radiation is varied.

20. A phased steered subsurface antenna system as claimed in claim 19 wherein:

said radiating elements are each open-end, centerfed, half-wave dipoles comprising a pair of conductors covered with insulator material.

21. A phased steered subsurface antenna system as claimed in claim 20 wherein said elements are colinear.

22. A phased steered subsurface antenna system as claimed in claim 20 wherein said elements of said pair are parallel and adjacently aligned.

23. A phase steered subsurface antenna system as claimed in claim 19 wherein each element of said pair of radiating elements comprises a plurality of open-end, centerfed, half-wave dipoles positioned such that each said plurality of dipoles effectively operates as a single dipole.

24. A subsurface antenna system having a radiation pattern exhibiting an improved directivity comprising:

a first pair of parallel, adjacently aligned and spaced apart doublets, each doublet having colinearly aligned spaced apart radiating elements;

a second pair of parallel, adjacently aligned and spaced apart doulets, each doublet having colinearly aligned spaced apart radiating elements whereby said first and second pair form a first subarray wherein all radiating elements are identically oriented and buried within a semi-infinite dissipative medium;

a second subarray identical to said first subarray lying in the same geometric plane therewith, and colinearly spaced apart therefrom, said first and second subarrays being totally electrically insulated from said medium and adapted to radiate or receive signals at a frequency in free space adjacent said medium, said doublets having their respective radiation centers spaced apart by at least one quarter free space wavelength of said frequency; and means coupled to said subarrays for applying signals to the elements thereof with a selected relative phase therebetewen, said spacing and said relative phase being chosen to enhance the desired directivity of said radiated signal in one direction and enhance the desired directivity of said received signal in another direction.

25. A subsurface antenna system as claimed in claim 24 wherein:

said pairs of doublets are spaced apart by a distance "s" and said signals applied thereto are in phase, said distance "s" being defined by the formula:

$$s=(\lambda_0/2)/\sin\theta_0$$

wherein:

s=the element spacing:

$\lambda_0$=the free space wavelength of the radiation; and $\theta_0$=the zenith angle of the directed radiation pattern.

26. A subsurface antenna system as claimed in claim 25 wherein:

said first pair of doublets are spaced apart from said second pair of doublets by a distance "b" and said signals applied thereto are −90° out of phase during the transmission mode and +90° out of phase during the receive mode, said distance "b" being defined by the formula:

$$b=(\lambda_0/4)/\sin\theta_0$$

wherein:

b=the element spacing;

$\lambda_0$=the free space wavelength of the radiation;

$\theta_0$=the zenith ange of the directed radiation.

27. A subsurface antenna system as claimed in claim 26 wherein:

said first subarray is colinearly spaced apart from said second subarray by a distance "d" and said signals applied thereto are in phase, said distance "d" being defined by the formula:

$$d=(\lambda_0/2)\sin\theta_0$$

wherein:

d=the subarray spacing $\lambda_0$=the wavelength of the free space frequency $\theta_0$=angle of maximum suppression.

* * * * *

UNITED STATES PATENT AND TRADEMARK OFFICE
CERTIFICATE OF CORRECTION

PATENT NO. : 4,687,445

DATED : August 18, 1987

INVENTOR(S) : JOHN C. WILLIAMS

It is certified that error appears in the above-identified patent and that said Letters Patent is hereby corrected as shown below:

Column 14, line 1, delete "antenna" and insert --second--.

Signed and Sealed this

Second Day of February, 1988

*Attest:*

*Attesting Officer*

DONALD J. QUIGG

*Commissioner of Patents and Trademarks*